US012636566B2

(12) United States Patent
Webb-Llano

(10) Patent No.: US 12,636,566 B2
(45) Date of Patent: May 26, 2026

(54) GOLF TRAINING APPARATUS

(71) Applicant: SQUAREFACE, INC., Ardmore, PA (US)

(72) Inventor: Paul Victor Webb-Llano, Northfleet (GB)

(73) Assignee: SQUAREFACE, INC., Ardmore, PA (US)

( * ) Notice: Subject to any disclaimer, the term of this patent is extended or adjusted under 35 U.S.C. 154(b) by 275 days.

(21) Appl. No.: 18/266,748

(22) PCT Filed: Dec. 10, 2021

(86) PCT No.: PCT/GB2021/053251

§ 371 (c)(1),
(2) Date: Jun. 12, 2023

(87) PCT Pub. No.: WO2022/129874

PCT Pub. Date: Jun. 23, 2022

(65) Prior Publication Data

US 2024/0082678 A1 Mar. 14, 2024

(30) Foreign Application Priority Data

Dec. 14, 2020 (GB) ..... 2019695

(51) Int. Cl.
*A63B 69/36* (2006.01)

(52) U.S. Cl.
CPC .... *A63B 69/36213* (2020.08); *A63B 2214/00* (2020.08); *A63B 2225/09* (2013.01)

(58) Field of Classification Search
CPC ..... A63B 69/3621; A63B 69/36211; A63B 69/36212; A63B 69/36213; A63B 2214/00; A63B 2225/00; A63B 47/008
(Continued)

(56) References Cited

U.S. PATENT DOCUMENTS 2,472,065 A * 6/1949 Cottingham ..... A63B 21/015 473/229
3,489,416 A * 1/1970 Mark ..... A63B 69/36211 473/258

(Continued)

FOREIGN PATENT DOCUMENTS

DE 202013006560 U1 7/2014

OTHER PUBLICATIONS

International Preliminary Report on Patentability for PCT International Application No. PCT/GB2021/053251 issued Jun. 29, 2023, 7 pages.

(Continued)

*Primary Examiner* — Sebastiano Passaniti

(74) *Attorney, Agent, or Firm* — Duane Morris LLP

(57) ABSTRACT

A golf training apparatus guides the execution of a golf shot. The apparatus comprises a first arm rotatable in a first plane about a first pivot at a first end of the first arm; a second arm coupled to the first arm and rotatable in second plane parallel to the first plane about a second pivot at a second end of the first arm and a first end of the second arm; and a gripper for coupling a golf club to the second arm, the gripper rotatable about a third pivot at a second end of the second arm such that a shaft of the club is rotatable about the third pivot in a third plane parallel to the first plane. The second arm is longer than the first arm. The apparatus can include a guide around which the first pivot is moveable, which can be a circular loop.

22 Claims, 6 Drawing Sheets

(58) Field of Classification Search
USPC ..... 473/257–261; 482/93, 100
See application file for complete search history.

(56) References Cited

U.S. PATENT DOCUMENTS 3,711,103 A * 1/1973 Seltzer ..... A63B 69/36211 473/259
3,794,329 A * 2/1974 Wilson ..... A63B 69/36211 473/229
4,047,605 A 9/1977 Rosenvold
4,280,701 A * 7/1981 Beckish ..... A63B 69/36211 473/221
4,583,740 A * 4/1986 Ohly ..... A63B 69/36211 473/259
5,125,882 A * 6/1992 La Mothe ..... A63B 21/4043 482/114
5,139,264 A * 8/1992 Wootten ..... A63B 21/154 473/229
5,242,344 A * 9/1993 Hundley ..... A63B 21/4047 482/93
5,301,948 A 4/1994 Hundley
5,467,993 A * 11/1995 Higginson ..... A63B 69/36211 473/259
5,947,834 A * 9/1999 Hope ..... A63B 69/36213 473/258
6,569,030 B1 * 5/2003 Hamilton ..... A63B 69/3621 473/219
7,611,420 B1 * 11/2009 Turner ..... A63B 69/36211 473/258
7,670,233 B2 * 3/2010 Jones ..... A63B 69/36211 473/226
9,283,463 B2 3/2016 Zimmerman, II et al.
10,646,766 B2 * 5/2020 Zimmerman, II . A63B 21/0058
2004/0001750 A1 * 1/2004 Kremerman ..... B25J 9/043 414/744.1
2008/0153618 A1 * 6/2008 Arther ..... A63B 69/3621 473/409
2013/0331195 A1 * 12/2013 Sery ..... A63B 69/36213 473/223
2014/0065586 A1 * 3/2014 Gabbai ..... G09B 19/00 434/247
2016/0038811 A1 2/2016 Lagier et al.

OTHER PUBLICATIONS

International Search Report and Written Opinion for PCT International Application No. PCT/GB2021/053251 issued Feb. 23, 2022, 9 pages.

* cited by examiner

GOLF TRAINING APPARATUS

CROSS REFERENCE TO RELATED APPLICATIONS

This application claims the benefit of UK Patent Application 2019695.2, filed Dec. 14, 2020, now GB Patent 2601825, issued Jun. 15, 2022; and International Patent Application PCT/GB2021/053251, filed Dec. 10, 2021, which are all hereby incorporated by reference for all purposes as if fully set forth herein.

FIELD

The present invention relates to a golf training apparatus, particularly to apparatus for improving a player's golf shot execution.

BACKGROUND

Golf is a sport that is enjoyed around the world from amateur to professional level and is a sport that requires tremendous skill and consistency to play well. One of the major difficulties that players of all levels face is being able to consistently execute the shots they intend to make. Often, due to technical issues with a player's golf swing, or variations in execution, a player will perform shots that lead to the ball coming to rest far from its intended target or, worse, the club failing to connect with the ball entirely. This can be a source of great frustration for the player, which can result in the player losing motivation and ceasing to play the sport.

A significant complicating factor is that a player must combine the club head parameters correctly to produce good golf shots. Another is that a player executes a shot from the side of the target line unlike for example darts, snooker, or free throw shooting in basketball, where the target is in front of the player. Playing from the side makes aim and alignment harder to master and changes the planes in which swing motions must be made.

Aim, alignment and motion planes are all extremely important at every skill level of golf and constantly need to be checked and tested.

Some systems for improving golf shots use ballistic analysis. A camera takes sequential procures of a golf ball as the player performs the shot. The motion of the ball is mapped into three dimensional space and feedback is provided to the player on the trajectory achieved. However, this type of device does not directly inform a player of the particular characteristics of his swing that result in the observed trajectory, so it is difficult for the player to adjust his swing to correct any unintended movement of the ball.

A golf swing requires the fine co-ordination of many muscles to ensure that the club face correctly and consistently impacts the ball. A player instinctively feels when a shot is right but is often unsure why a shot is wrong. Practising the correct movements can improve co-ordination and ensure that the correct movement is remembered and hopefully repeated effortlessly.

Accordingly, other types of training machine, such as that described in US2003114238A1 allow users to practice feeling a swing movement. This apparatus comprises an articulated assembly controlled by a hydraulic system that keeps the hands of the user within an anatomically optimal plane while allowing a golf club to be moved by the user in a manner consistent with the most desirable swing motion present in a natural golf swing (according to the designer).

One type of golf training apparatus includes robotic devices that may be electronically controlled to deliver consistent golf swings. This type of apparatus actively moves the club and enables a player to feel the motion of the club through a simulated swing, teaching them how to swing the golf club to achieve a particular shot. One such device is described in U.S. Pat. No. 7,806,780B1 which features a robotic, golf trainer comprising a circular track supported by telescopically adjustable legs, with a carriage unit moveable along the track to guide a golf club. While such apparatus provides a player with the feeling of a swing movement, the player is instructed to remain as inactive as possible and follow the robot's training direction. This results in limited practical benefit when the player attempts to perform the swing on their own. A similar device is described in WO2013039836A1.

The perfect golf swing is dependent on the physical characteristics and idiosyncrasies of the individual player. What is needed is a training apparatus geometry than can accommodate these differences while still effectively training the player, improving their swing and executing perfect golf shots.

SUMMARY

The present invention relates to a golf training apparatus comprising: a first arm 6 rotatable in a first plane up to 35 degrees from vertical about a first pivot 2 at a first end of the first arm; a second arm 7 coupled to the first arm and rotatable in second plane parallel to the first plane about a second pivot 3 at a second end of the first arm and a first end of the second arm; a gripper 5 for coupling a golf club to the second arm, the gripper rotatable about a third pivot 4 at a second end of the second arm such that a shaft of the club is rotatable about the third pivot in a third plane parallel to the first plane; wherein: the second arm is longer than the first arm such that the gripper is positioned to hold the club close to a club face; and the apparatus guides the club to execute a golf shot with predetermined parameters.

The gripper 5 is preferably further rotatable about a pivot lying in the third plane such that the shaft of a golf club held in the gripper is axially rotatable.

One or more of the pivots may be controlled by an electric motor which assists or resists rotation in order to control additional parameters of the golf shot.

In use, the bottom of the gripper 5 is preferably positioned within 80 mm of a sole of the club.

The gripper 5 may be adapted to hold the club around the ferrule or hosel.

The golf training apparatus may further comprise: a base 8 for anchoring the apparatus between a golfer and a ball; a shoulder 9 rotatable relative to the base on a pivot 1 with a vertical axis 1 and upon which the first pivot 2 is mounted.

The shoulder may comprise two bodies 10, 11 separated by a joint 12 moveable to adjust the angle of the first plane. In one embodiment, the shoulder fixes the first plane between 18 and 20 degrees to the vertical. In another embodiment, the shoulder fixes the first plane between 25.6 and 25.9 degrees to the vertical.

The golf training apparatus may further comprise: a guide 15 mounted on the base in a guide plane adjustable between 10 and 35 degrees to the vertical, around which the first pivot is moveable.

The guide is preferably a circular loop. In use, a golfer may stand through the loop.

The guide plane may be parallel to the first plane.

The guide preferably comprises two concentric rings rotatable relative to each other about their shared axis. The two rings preferably comprise an inner ring and an outer ring with one or more bearings at an interface between them.

The shoulder is preferably attached to the outer ring and the first arm pivot 2 is attached to the inner ring.

The golf training apparatus may further comprise a base 13 for anchoring the guide between a golfer and a ball, wherein the guide 15 is rotatable relative to the base about a vertical pivot 1 and the guide plane is adjustable at a joint 12 between the base and the guide.

The golf training apparatus preferably further comprises a controller which controls motors or actuators on one or more of the joints and pivots of the apparatus according to stored parameters to execute the golf shot. The parameters may define the swing required for a specific golfer to achieve a specific ball trajectory.

The controller may adjust the signals sent to the motors or actuators based on the forces exerted on the apparatus by a player using the apparatus. The signals sent to the motors or actuators may be used to provide feedback to the player on the execution of their shot.

The present invention further comprises a method for improving the golf swing of a golfer comprising: placing a golf club suitable for the required shot in the club gripper of the apparatus of any previous claim; having the golfer hold the golf club using their standard posture and grip; setting any adjustable parameters of the apparatus to perform the required shot; allowing the golfer to make the shot, guided by the apparatus.

The shot is preferably executed using a real golf ball.

BRIEF DESCRIPTION OF THE DRAWINGS

The invention will now be described solely by way of example and with reference to the accompanying drawings in which:

FIG. 2 shows a sequence of movements involved in a putting stroke as follows: 2A—Address position, 2B—Takeaway, 2C—End of backswing, 2D—Downswing, 2E—Impact, 2F—Post impact, 2G—End of follow through.

FIG. 3 shows a sequence of movements involved in a chip shot as follows: 3A—Address position, 3B—Forward press, 3C-Takeaway, 3D—End of backswing, 3E—Transition (the clubhead keeps going back as the grip end starts to go forwards, creating "lag" and initiating the downswing), 3F—Pre-Impact, 3G—Impact (the leading edge of the clubface hits the back of the ball and the ground at the same time), 3H—Post-impact (the bottom of the clubface is below ground level), 3I—End of follow through.

DETAILED DESCRIPTION

Figure 1:
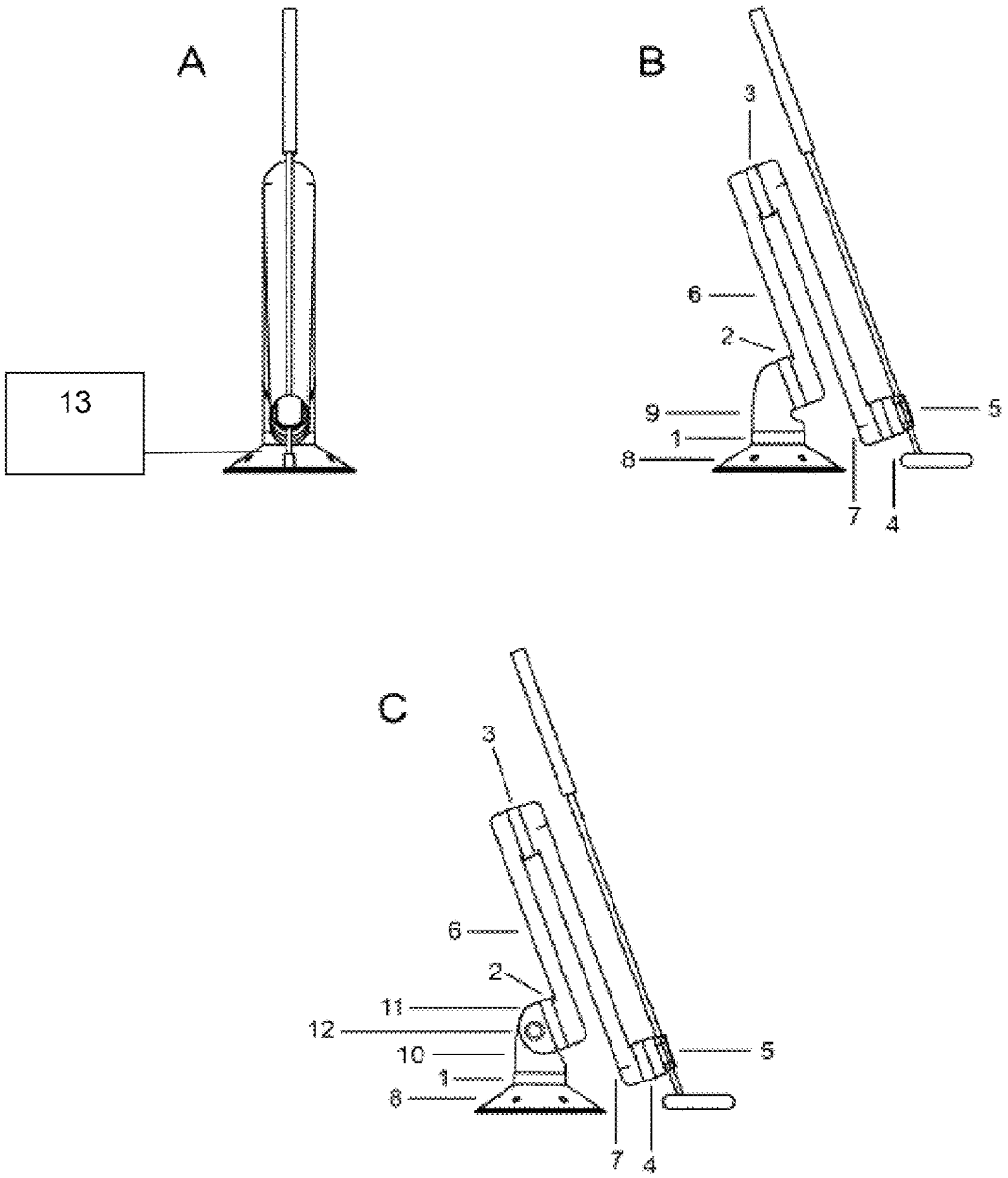
FIG. 1A is a view of putting and chipping apparatus according to the present invention, with 1A showing a view from in front looking towards a player (not shown) using the apparatus; 1B showing the same apparatus from the player's right side; and 1C showing an optional adjustable shoulder.

FIG. 1 shows the main features of an embodiment of the present invention used for performing or training a player to perform a putt or chip shot.

The apparatus comprises a base 8 for firmly anchoring the apparatus to the ground in a position between a player and a ball. The position and dimensions of the base 8 are such that it does not interfere with the player's natural stance. The base is preferably circular in horizontal section to assist players to improve their aim and alignment. It has been found that straight edges on the base can act as false guides, adversely affecting aim and alignment. In FIG. 1, the base shown is frusto-conical but it may be a disc or cylindrical in shape. It is preferably heavy in order to stabilise the apparatus and may comprise weights which may be made of concrete or metal. Alternatively, it may be hollow such that it can be filled with water or sand to weigh it down. In a preferred embodiment, the base houses a battery, preferably a rechargeable battery, such as a lithium ion battery, to power the apparatus and provide stabilising weight. The base 8 may include vertical holes through which securing pegs may be pushed or hammered into the ground or may include integral spikes which protrude into the ground.

A shoulder 9 is positioned on top of the base. The top face of the shoulder determines the angle at which the further components of the apparatus are connected to the base. This may be a fixed angle. For example, an angle of between 18 and 20 degrees to the vertical is suitable for a putter. An angle of between 25.6 and 25.9 degrees to the vertical is suitable for a wedge. Alternatively, the angle may be adjustable to accommodate the different lie angles of different clubs, as shown in FIG. 1C. In this case, the shoulder may comprise two bodies 10, 11 hinged about a shoulder pivot 12 with a horizontal axis. Movement of the shoulder pivot 12 may be restricted allowing the top face of the shoulder to take an angle between 10 degrees and 35 degrees from the vertical. In one embodiment, the shoulder pivot 12 may be clamped at the appropriate angle for a particular club, for example by a central bolt and nut. The faces of one or both bodies 10, 11 may be contoured or ribbed where they abut each other around the axis to assist in selecting and retaining an appropriate angle. In another embodiment, the shoulder pivot 12 may include a drive module or actuator (as described later) to adjust the angle under computer control.

The shoulder is preferably rotatable relative to the base on a base pivot 1 with a vertical axis. The shoulder is preferably rotatable a full 360 degrees to allow the player to direct the apparatus in any desired direction. In one embodiment, the base pivot may be clamped in a predetermined position prior to taking a shot. However, in a preferred embodiment, the base pivot can rotate up to 25 degrees in either direction from its initial position during the shot to accommodate a player's club path. This may allow a player to direct their initial swing line wide of a target and still put sufficient curve on the ball to get it back to the target. The base pivot may include a drive module or actuator (as described later) to rotate the shoulder under computer control.

A first arm 6 is connected to the top face of shoulder 9 via a first arm pivot 2 close to a first end of the first arm 6. The first arm 6 is rotatable in a first plane at an angle determined by the shoulder 9. It rotates about the first arm pivot 2 close to the first end of the first arm 6 such that the second end of the first arm 6 describes an arc in the first angled plane. A second arm is connected to the first arm via a second arm pivot 3 close to the second end of the first arm 6 and close to a first end of the second arm 7. The second arm 7 can therefore rotate relative to the first arm 6 in a second plane parallel to the first plane.

The second arm 7 is longer than the first arm 6 such that when the first arm 6 is directed up, the second end of the second arm 7 is close to the ground. In this configuration, the second end of the second arm 7 is between 50 mm and 200 mm from the ground, preferably 100 mm from the ground. This ensures the club face is correctly positioned relative to a ball on the ground or on a tee when a second end of the second arm 7 is connected to a golf club near to the club head. The lengths of the first and second arms are such that a player can hold a club in the apparatus naturally, as he would when not using the apparatus, and the arms and particularly the second arm pivot do not interfere with the player's stance.

The combination of two arms ensures that a second end of second arm 7 can reach any position within a roughly semi-circular area of the second plane with radius equal to the sum of the length of the two arms and bounded by the ground.

The first arm 6 and the second arm 7 may be rods, tubes or of box section. They may be made from metal, carbon fibre, wood or plastic. They should be light so as not to affect the feel of the swing but of sufficient strength to bear the significant forces involved in controlling a golf swing.

A gripper 5 for coupling a golf club is connected to the second end of the second arm 7. The gripper 5 holds the club so that the club shaft lies in a third plane parallel to the first and second planes.

The gripper 5 holds the shaft of a golf club close to the club face or is adapted to hold the club around the ferrule or hosel. The gripper includes a clamp adapted to prevent movement of the club relative to the gripper 5. In one embodiment, the internal surfaces of the clamp may be specifically shaped to mirror the contours of a club ferrule or hosel in order to prevent longitudinal movement of the club relative to the gripper 5. Alternatively, or additionally the clamp may incorporate an elastic material such as rubber or silicone to hold the club firmly and prevent damage to the club.

Holding the club shaft close to the club face, and particularly around the ferrule or hosel, allows the apparatus to finely control the club face. A small movement of the club handle by a player can result in a large movement of the club face. However, by controlling the club near the bottom of the shaft, the apparatus can control the face very accurately. In this context, "near the bottom of the shaft", "close to the club face" or "near a sole of the club" means within 150 mm of the sole of the club, preferably within 80 mm of the sole of the club.

The gripper 5 is further adapted to allow axial rotation of the club. In one embodiment, the clamp is held by a bearing fixed within the gripper 5. For putting practice, the axial rotation may be restricted to prevent rotation of the club head by more than 20 degrees, preferably 10 degrees either side of square with the ball. The axial rotation of the club may be driven by a motor or actuator (as described later) under computer control.

The gripper 5 is rotatable relative to the second arm 7 to allow the club to rotate in the third plane. This rotation is effected around a third pivot 4 which is similar in design to the first arm pivot 2 and second arm pivot 3.

The base pivot 1, first arm pivot 2, second arm pivot 3, third pivot 4 and axial rotation of the clamp within the gripper provide five degrees of freedom to the club head during a golf shot. The base pivot 1 mainly adjusts the overall orientation of the club path. The first arm pivot 2 mainly adjusts an angle of attack; the second arm pivot 3 mainly controls a club head swing; the third pivot 4 adjusts a club shaft lean allowing the important shift of a players hands ahead of or behind the club face and controlling the dynamic loft of the shot; and the axial rotation of the clamp within the gripper 5 adjusts the club face angle. Control of these pivots allows control of the major parameters affecting a golf shot.

The base pivot 1, shoulder pivot 12, first arm pivot 2, second arm pivot 3 and third pivot 4 are all substantially similar in design. Each is freely rotatable through a range of angles. In some cases the extent of the rotation may be limited by a mechanical stop to prevent the apparatus taking an undesirable configuration or to prevent the apparatus moving into a particularly poor swing configuration. In a passive mode of operation, these are the only limitations on the swing but, while this can be helpful, it is not particularly instructive for the player.

Some of all of the pivots and the axial rotator of the gripper include actuators to assist or resist the motion imparted to the apparatus by a golfer making a swing. In one embodiment the actuator may be an electric motor. In a preferred embodiment, the actuators may be strain wave drives, such as the Harmonic Drive® servo actuators manufactured by Harmonic Drive SE. A harmonic drive has no backlash, high compactness and light weight, good movement resolution and excellent repeatability when repositioning inertial loads, a high torque capability, and the gear ratio is easy to set as appropriate for each actuator, making it ideal for use in this apparatus. It helps give a smooth natural feeling to a player as each shot is executed in the apparatus. In another embodiment, it may comprise a pneumatic system with controllable valves.

Some or all of the pivots and the axial rotator of the gripper may also include sensors to provide signals indicating the angular position of the pivot. These sensors may be an integral part of or derived from the drive motor (e.g. a stepper motor) or may be separate sensors. Additional sensors may monitor forces on the pivots and rotator and the speed of rotation of the pivots and rotator. The sensors may be torque sensors providing the torque on the actuator or force sensors providing information about non-rotational forces acting on the pivots and rotator. Force sensors may provide information about forces in all three orthogonal spatial axes to provide comprehensive information about forces applied to the pivots by the player. Data provided by the sensors allow a computer or controller 13 to adjust the configuration of the apparatus in real time to guide execution of a golfing shot. The sensor data relating to each shot can be stored and may be replayed to the player either via movement of the apparatus or via visual computer simulation, for training purposes.

Movement of the pivots and rotator is controlled by a computer or controller 13 which has stored swing parameters required to effect a plurality of desired shot. The stored parameters may be specific to a particular player or may be generic idealised parameters. Using the stored parameters and sensor signals, the computer 13 calculates the ideal drive signal to provide to each of the actuators in the apparatus. The sensor signals enable the computer 13 to take account of forces exerted by a player using the apparatus when calculating the drive signals and so to assist or resist movements made by the player and thereby guide the player to make the perfect shot. The calculation may also take into account the player's physical strength when deciding the drive required from the actuators. In an automatic mode, the apparatus may make the shot without any involvement from the player.

The computer 13 may also provide drive signals to prevent the apparatus getting into an unwanted configuration and may remove drive from the actuators to prevent injury to a player or damage to the apparatus if a sensor signals excessive forces. All drive may be removed if an emergency stop or emergency release button is pressed.

Physical feedback is provided to the player in terms of the feeling of assistance or resistance to the shot and further specific feedback can be provided by the computer 13 in reporting which actuators were used and to what degree. This allows the software running on the computer 13 to identify the key parameters of a player's shot execution and provide optimum feedback for swift improvement. Haptic feedback, such as that provided by this apparatus, has been shown to speed up improvements in golf shot execution. A human golf professional can also gain a better understanding of each and every player and provide tailored advice based on the data collected by the apparatus. As the amount of data relating to each player increases, so does the ability of the apparatus to teach every player individually based on their natural technique, instincts and tendencies.

Figure 2:
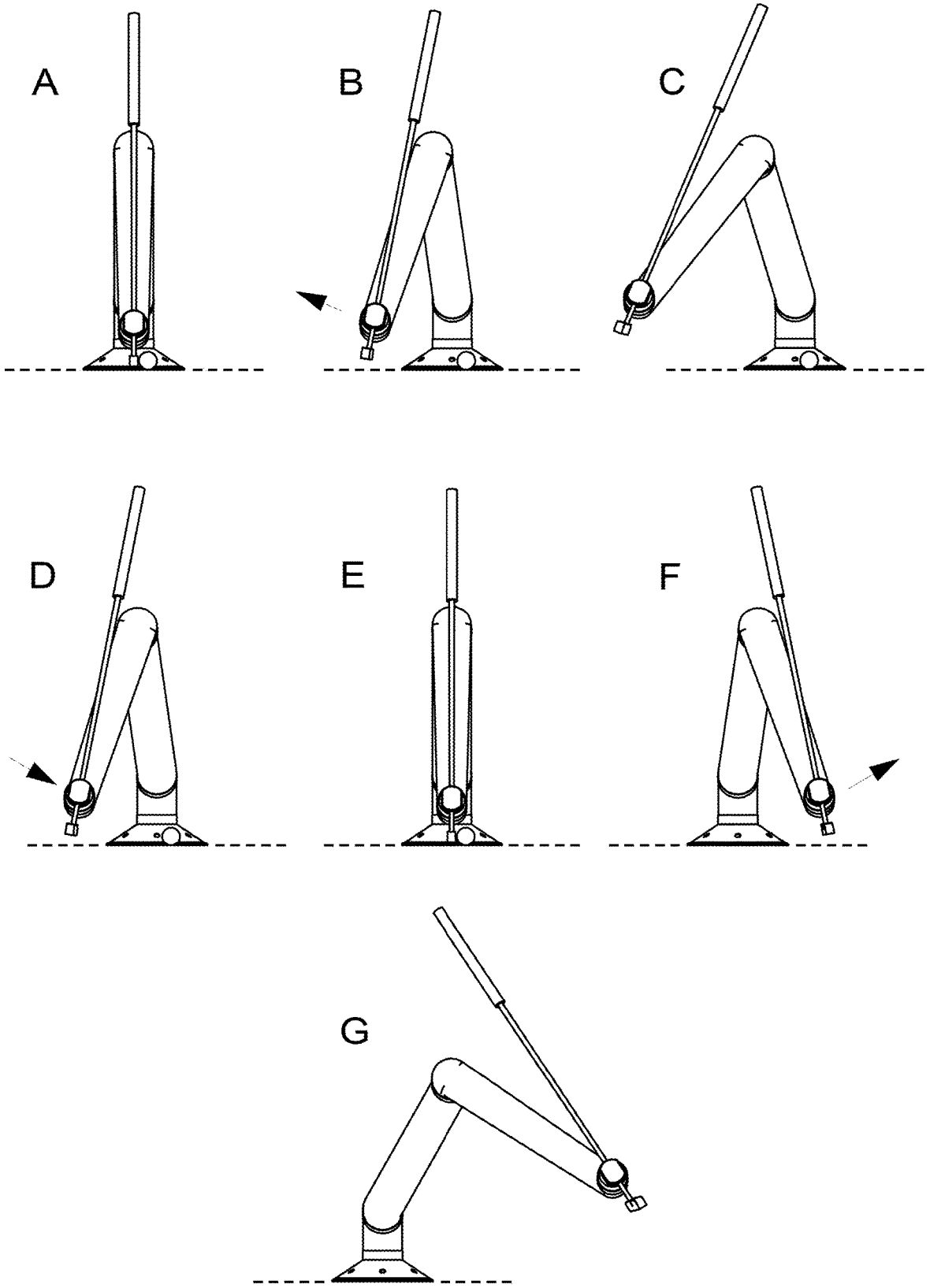

FIG. 2 shows the configuration of the apparatus during the execution of a putt. A putter club is held in the gripper. At FIG. 2A the player (not shown) addresses the ball. At 2B he begins a backswing guided by the apparatus. At 2C the backswing is complete and the player begins to make the downstroke. The apparatus moves through the configuration of 2D and the club hits the ball at 2E. The putter then follows through at 2F, finishing at 2G.

Figure 3:
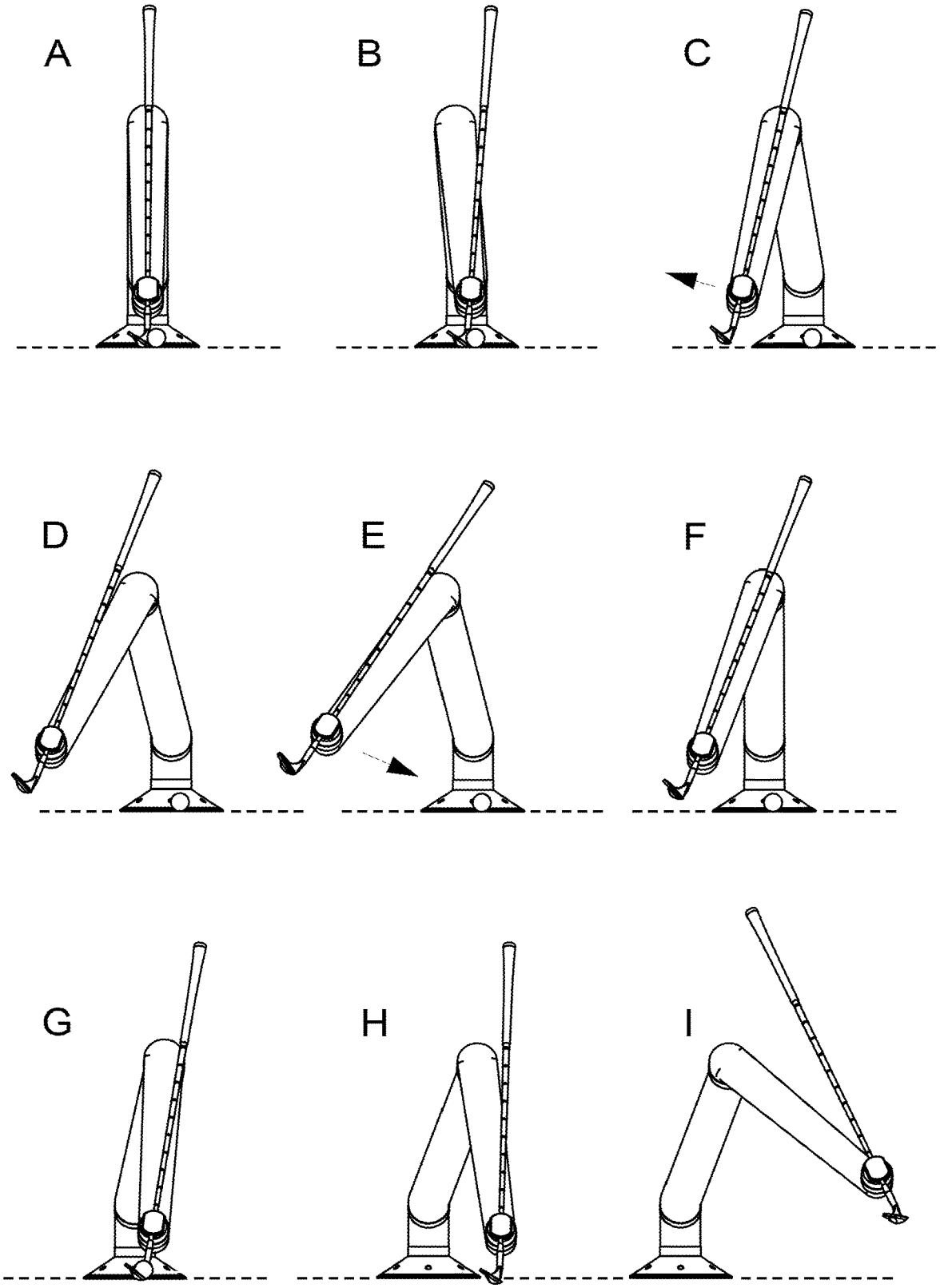
Figure 4:
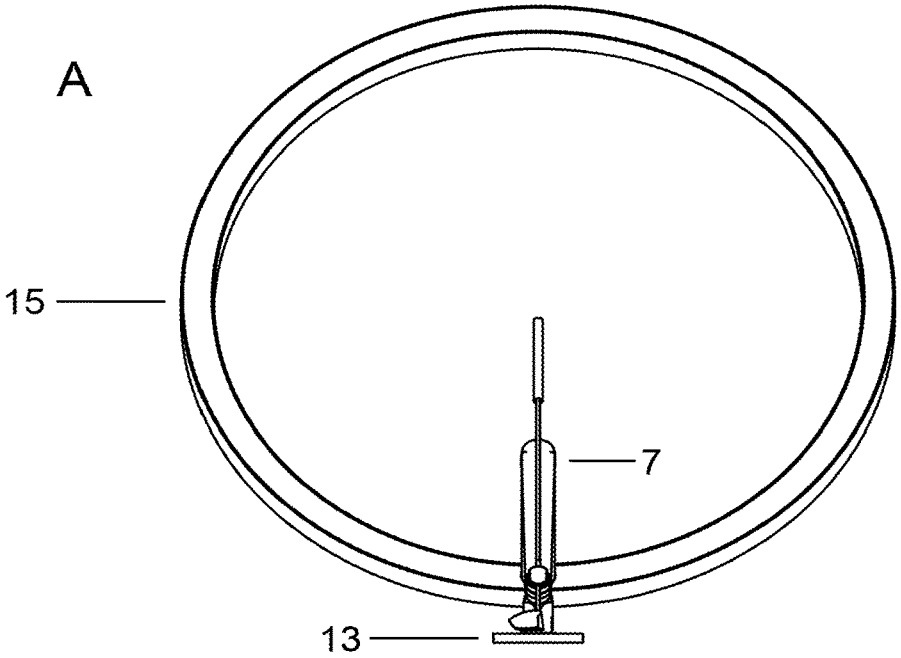
FIG. 4 shows a full swing apparatus according to the present invention, with 4A showing a view from in front looking towards the player; and 4B showing the same apparatus from the player's right side.
Figure 4:
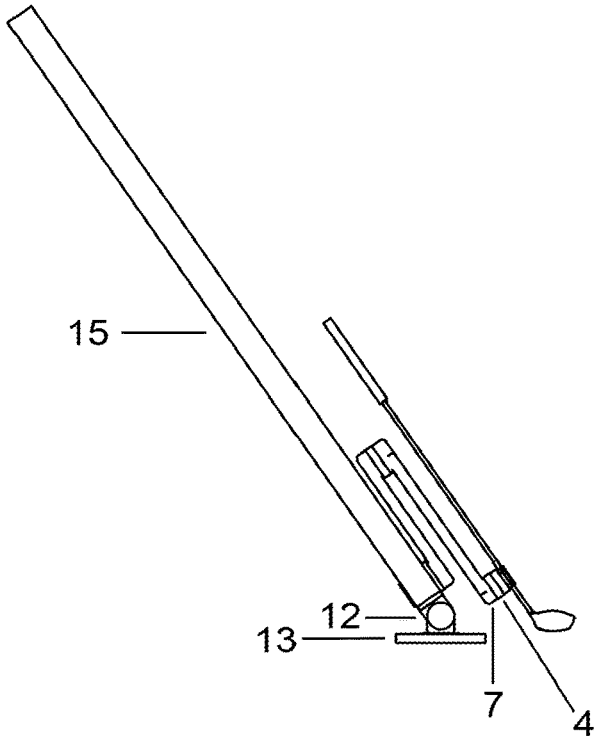

FIG. 3 shows the configuration of the apparatus during a chip shot. A wedge club is held in the gripper and the shoulder pivot is adjusted to accommodate the lie angle of the club. At FIG. 3A the player (not shown) addresses the ball. At 3B he makes a forward press that brings the club's grip more in line with his front leg and sets up a straight line from the player's shoulder down his arm, through the club to the ball. This forward press movement also de-lofts the club and can be used by players to initiate their backswings. At 3C, the player moves the club away to reach the end of the backswing at 3D. FIG. 3E shows the transition phase in which the club head keeps going back as the grip end starts to go forwards, creating a lag between the grip and the club head during the downswing. Creating "lag" in the downswing stores power and generates more speed to apply to the ball. The opposite of lag is "casting". Many players cast the club from the top of the backswing and as a result lose power, hit the ball with the incorrect angle of attack and never really feel the excitement of a properly executed shot. Inexperienced players generally cast because they feel that the club needs help to raise the ball into the air. However, a slight downward angle of attack (4.5 degrees down is recognised as a decent angle for a pitching wedge) helps the club face to compact the ball lying on the ground and then the loft elevates the ball into the air. FIG. 3F shows the swing pre-impact and 3G shows impact with the leading edge of the clubface hitting the back of the ball and the turf at the same time. Players "duff" their shot when they hit the turf too early and "thin" it when they hit too much of the ball first. FIG. 3H shows the apparatus configuration post-impact, with the bottom of the clubface below ground level making a divot in the turf. Finally, FIG. 3I shows the end of the follow through and end of the stroke.

In another embodiment, the putting and chipping apparatus can be adapted to accommodate a full swing iron or driver shot. A circular guide 15 is incorporated between the shoulder 9 and first arm pivot 2 to allow the first arm pivot to move laterally relative to shoulder 9. The circular guide 15 comprises two concentric rings with one or more bearings at the interface between them, allowing one ring to rotate while the other remains stationary. In a preferred embodiment, there is an inner ring and an outer ring. The shoulder 9 is attached to the outer ring and the first arm pivot 2 is attached to the inner ring.

The guide 15 may be made from metal, carbon fibre or plastic. The forces on the apparatus during execution of a shot are considerable and the arrangement provides a more robust solution than, for example, a carriage type apparatus. The forces are evenly distributed around the rings reducing wear on the bearing and allowing a reduction in the material required to give the guide sufficient strength. This reduces weight and improves the portability and stability of the apparatus. For these reasons an inner ring and an outer ring configuration is also preferred over a front ring and a back ring configuration.

The guide 15 lies substantially in a plane parallel to the first plane. The player stands through the guide 15 to use the apparatus. The guide preferably has a diameter of 1,800 mm to 2,000 mm. The two arm arrangement between the first arm pivot 2 and the gripper 5 allows players of a wide variety of sizes to use the apparatus without the need for different guide sizes. A junior player may swing with the arms 6, 7 extending further inside the guide 15 than shown while a large adult player would swing with the arms 6, 7 extending further outside the guide 15 than shown.

An example of this embodiment is shown in FIG. 3.

In one embodiment, the bearing between the rings comprises wheels or rollers. Alternatively, an air bearing may be used to ensure free relative rotation of the rings. Small holes around the interface between the two rings may allow the escape of high pressure air and so provide an air cushion layer between the two rings to allow virtually frictionless relative motion. One or both rings may be hollow and may provide a duct for the air used by the air bearing. Preferably this is the outer ring to avoid the need for air ducts to cross the interface between the rings.

The ring carrying the first pivot 2 can be driven around the ring fixed to the shoulder 9 by an actuator under computer control. The actuator may be a motor fixed to one ring driving a gear that engages with an internal or external gear around the other. A belt drive may also be used. The actuators may be similar to the other actuators in the apparatus.

The guide includes sensors, which may be similar to those in other actuators in the apparatus, to allow analysis of a shot, data used to control the actuators and feedback to a player. In particular, the guide includes a sensor providing the relative position of the first arm pivot relative to the shoulder.

Some golfers have a 2 plane golf swing. For example, the ideal backswing may be between 5 and 7 degrees more upright than the downswing. The present invention can accommodate this by movement of the shoulder pivot 12, which is always adjustable when the apparatus includes the circular guide 15. The shoulder pivot 12 may include a drive module or actuator, such as previously described, to adjust the angle under computer control.

Figure 5:
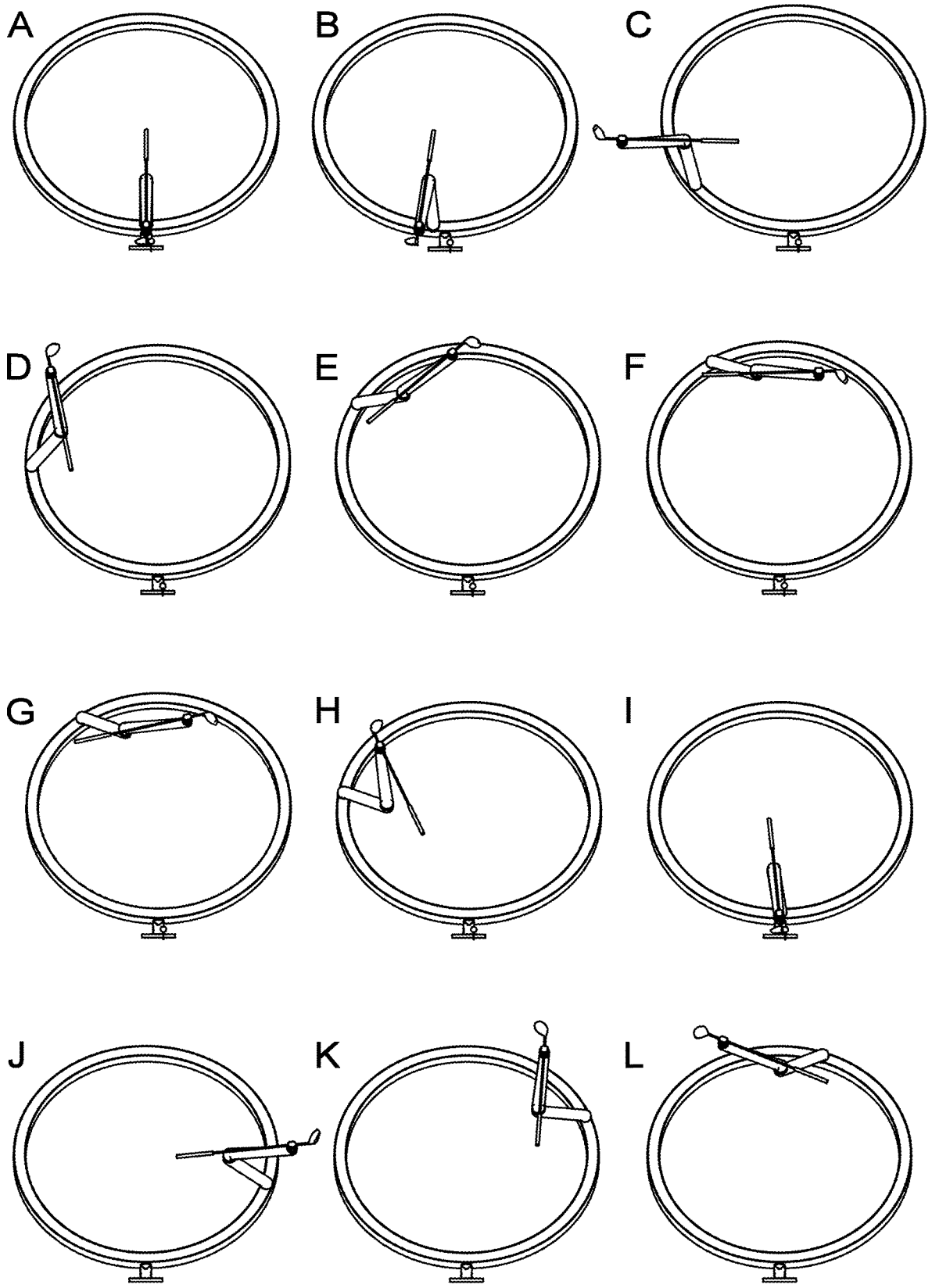
FIG. 5 shows a sequence of movements involved in a full swing drive as follows: 5A—Address position, 5B—Takeaway, 5C—Club shaft parallel to the ground, 5D—Half swing, 5E—Three quarter backswing, 5F—Top of the backswing, 5G—Transition, 5H—Delivery position, 5I—Impact, 5J—Post impact, 5K—Sawn off finish, 5L—Follow through finish.
Figure 6:
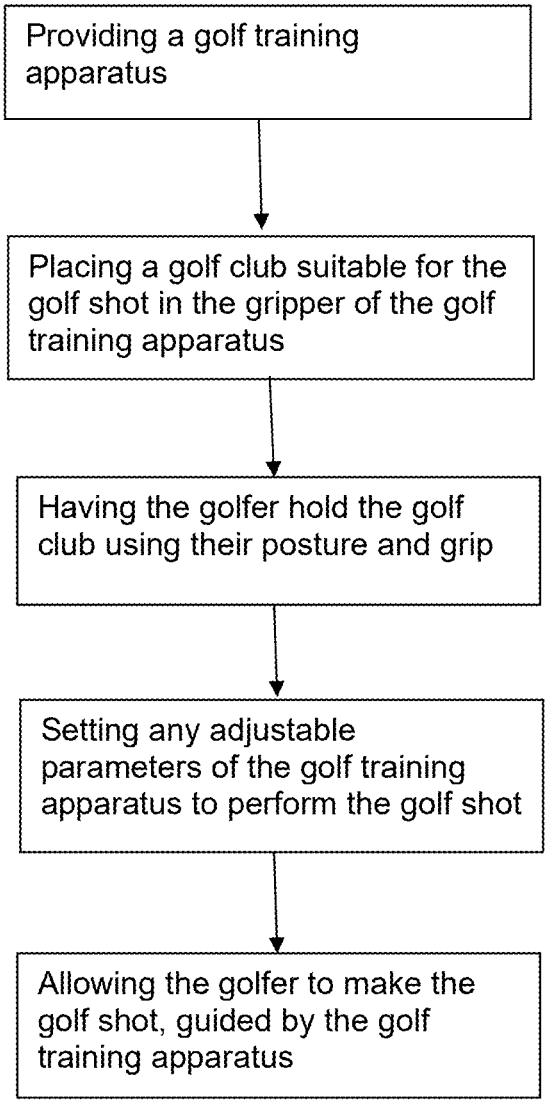
FIG. 6 shows steps in a method for improving a golf swing of a golfer using the golf training apparatus.

FIG. 5 shows the configuration of the apparatus during the execution of a full drive shot. A driver club is held in the gripper. At A, a player (not shown) addresses the ball. The backswing begins with the "takeaway" at B and progresses through C, D and E to the top of the backswing at F. The swing then progresses down through the delivery position at H to the impact position at I where the club strikes the ball. The swing then continues through J and K to reach the full swing finish at L.

During the backswing, the gripper rotates allowing the club face to rotate through approximately 95 degrees. This positions the club face in a typically square textbook position at the top of the backswing. This then rotates back during the downswing such that the ball is hit squarely and then carries on into the follow through with the club face rotating approximately 75 degrees in the other direction creating a "release effect".

If the club face rotates more in the backswing (120 degrees, for example) then the club face at the top of the backswing is classed as "open and weak". If the rotation is less than 95 degrees, it is referred to as "closed", "shut" and/or "a strong club face" and the club face "points to the sky".

From a weak position at the top of the backswing, the player potentially has more work to do to "square the face" at impact and achieve the required shot. From a strong position, the player normally has to speed up the body otherwise the club face could arrive in a closed position and send the ball left.

It is to be understood that any feature described in relation to one embodiment may be used alone or in combination with other features described and may also be used in combination with one or more features of one or more other embodiments, so long as technically feasible. Furthermore, equivalents and modifications not described may also be employed without departing from the scope of the invention, which is defined by the following claims.

The invention claimed is:

1. A golf training apparatus for use with a golf club including a grip at a first end of a shaft and a club head including a sole and a club face attached to a second end of the shaft via a ferrule or a hosel, the golf training apparatus comprising:

a first arm rotatable in a first plane up to 35 degrees from vertical about a first pivot at a first end of the first arm;

a second arm coupled to the first arm and rotatable in a second plane parallel to the first plane about a second pivot at a second end of the first arm and a first end of the second arm; and a gripper for coupling the golf club to the second arm, the gripper rotatable about a third pivot at a second end of the second arm such that the shaft of the golf club is rotatable about the third pivot in a third plane parallel to the first plane; wherein:

the second arm is longer than the first arm such that the gripper is positioned to hold the golf club adjacent to the club face; and the apparatus guides the golf club to execute a golf shot.

2. The golf training apparatus of claim 1, wherein the gripper is further rotatable about a pivot lying in the third plane such that the shaft of the golf club held in the gripper is axially rotatable.

3. The golf training apparatus of claim 1, wherein one or more of the first, the second, and the third pivots is controlled to assist or resist rotation in order to control the golf shot.

4. The golf training apparatus of claim 1, wherein, in use, a bottom of the gripper is positioned within 80 mm of the sole of the golf club.

5. The golf training apparatus of claim 1, wherein the gripper is adapted to hold the golf club around the ferrule or the hosel.

6. The golf training apparatus of claim 1 further comprising:

a base configured for anchoring the golf training apparatus; and a shoulder rotatable relative to the base on a fourth pivot with a vertical axis and upon which the first pivot is mounted.

7. The golf training apparatus of claim 6, wherein the shoulder comprises two bodies separated by a joint moveable to adjust an angle of the first plane.

8. The golf training apparatus of claim 6, wherein the shoulder fixes the first plane between 18 and 20 degrees to the vertical.

9. The golf training apparatus of claim 6 wherein the shoulder fixes the first plane between 25.6 and 25.9 degrees to the vertical.

10. The golf training apparatus of claim 1 further comprising: a guide mounted on a base in a guide plane adjustable between 10 and 35 degrees to the vertical, around which the first pivot is moveable.

11. The golf training apparatus of claim 10, wherein the guide is a circular loop configured and sized such that a golfer can stand through the guide.

12. The golf training apparatus of claim 10, wherein the guide plane is parallel to the first plane.

13. The golf training apparatus of claim 10, wherein the guide comprises two concentric rings rotatable relative to each other about a shared axis.

14. The golf training apparatus of claim 13, wherein the two rings comprise an inner ring and an outer ring.

15. The golf training apparatus of claim 14, wherein the shoulder is attached to the outer ring and the first arm pivot is attached to the inner ring.

16. The golf training apparatus of claim 10, wherein the base is configured for anchoring the guide, the guide is rotatable relative to the base about a vertical pivot, and the guide plane is adjustable at a joint between the base and the guide.

17. The golf training apparatus of claim 1 further comprising a controller that controls one or more of the joints and the pivots to execute the golf shot.

18. The golf training apparatus of claim 17, wherein the controller controls a swing for a specific golfer to achieve a specific ball trajectory.

19. The of claim 17 wherein the controller adjusts signals sent to the golf training apparatus based on forces exerted on the golf training apparatus by a golfer using the golf training apparatus.

20. The golf training apparatus of claim 19, wherein the signals are used to provide haptic feedback to the golfer on execution of their golf shot.

21. A method for improving a golf swing of a golfer, the method comprising:

providing a golf training apparatus for use with a golf club including a grip at a first end of a shaft and a club head including a sole and a club face attached to a second end of the shaft via a ferrule or a hosel, the golf training apparatus including:

a first arm rotatable in a first plane up to 35 degrees from vertical about a first pivot at a first end of the first arm;

a second arm coupled to the first arm and rotatable in a second plane parallel to the first plane about a second pivot at a second end of the first arm and a first end of the second arm; and a gripper for coupling the golf club to the second arm, the gripper rotatable about a third pivot at a second end of the second arm such that the shaft of the golf club is rotatable about the third pivot in a third plane parallel to the first plane; wherein:

the second arm is longer than the first arm such that the gripper is positioned to hold the golf club adjacent to the club face; and the apparatus guides the golf club to execute a golf shot placing the golf club in the gripper of the golf training apparatus;

having the golfer hold the golf club;

setting the golf training apparatus to perform a golf shot; and allowing the golfer to make the golf shot, guided by the golf training apparatus.

22. A method of claim 21, wherein the golf shot is executed using a golf ball.

* * * * *